US008454723B2

(12) United States Patent
Liu et al.

(10) Patent No.: US 8,454,723 B2
(45) Date of Patent: Jun. 4, 2013

(54) SAPROLITE NEUTRALISATION OF HEAP LEACH PROCESS

(75) Inventors: Houyuan Liu, Henderson, NV (US); Eric Girvan Roche, Booragul (AU)

(73) Assignee: BHP Billiton SSM Development Pty Ltd., Perth, Western Australia (AU)

( * ) Notice: Subject to any disclaimer, the term of this patent is extended or adjusted under 35 U.S.C. 154(b) by 80 days.

(21) Appl. No.: 12/991,848

(22) PCT Filed: Jun. 16, 2009

(86) PCT No.: PCT/AU2009/000758

§ 371 (c)(1),
(2), (4) Date: Dec. 30, 2010

(87) PCT Pub. No.: WO2009/152560

PCT Pub. Date: Dec. 23, 2009

(65) Prior Publication Data

US 2011/0083533 A1 Apr. 14, 2011

(30) Foreign Application Priority Data

Jun. 16, 2008 (AU) ..... 2008903045

(51) Int. Cl.

| | |
|---|---|
| ***C22B 3/06*** | (2006.01) |
| ***C22B 3/44*** | (2006.01) |
| ***C22B 23/00*** | (2006.01) |
| ***C01F 7/34*** | (2006.01) |

(52) U.S. Cl.
USPC ..... 75/743; 423/150.1; 423/127

(58) Field of Classification Search
USPC ..... 75/743; 423/150.1, 127
See application file for complete search history.

(56) References Cited

U.S. PATENT DOCUMENTS

| | | | | |
|---|---|---|---|---|
| 5,571,308 | A * | 11/1996 | Duyvesteyn et al. | 75/430 |
| 6,312,500 | B1 * | 11/2001 | Duyvesteyn et al. | 75/712 |
| 7,416,711 | B2 * | 8/2008 | Liu et al. | 423/140 |
| 2011/0110832 | A1 * | 5/2011 | Clareti Pereira et al. | 423/161 |

FOREIGN PATENT DOCUMENTS

| | | |
|---|---|---|
| WO | WO 2005/005671 | 1/2005 |
| WO | WO 2006/000020 | 1/2006 |
| WO | WO 2006/084335 | 8/2006 |

OTHER PUBLICATIONS

International Search Report for WO 2009/152560 dated Aug. 10, 2009.

* cited by examiner

*Primary Examiner* — George Wyszomierski
*Assistant Examiner* — Tima M McGuthry Banks
(74) *Attorney, Agent, or Firm* — Brinks Hofer Gilson & Lione; G. Peter Nichols

(57) ABSTRACT

A heap leach process for the recovery of nickel and/or cobalt from a laterite ore, said process including the steps of: a) providing one or more heaps of a nickeliferous laterite ore; b) leaching the ore in a heap leach step by applying acid to one or more heaps to provide a pregnant leach solution; c) neutralizing the pregnant leach solution with ground saprolite ore; and d) recovering the nickel and/or cobalt from the neutralized pregnant leach solution.

18 Claims, 1 Drawing Sheet

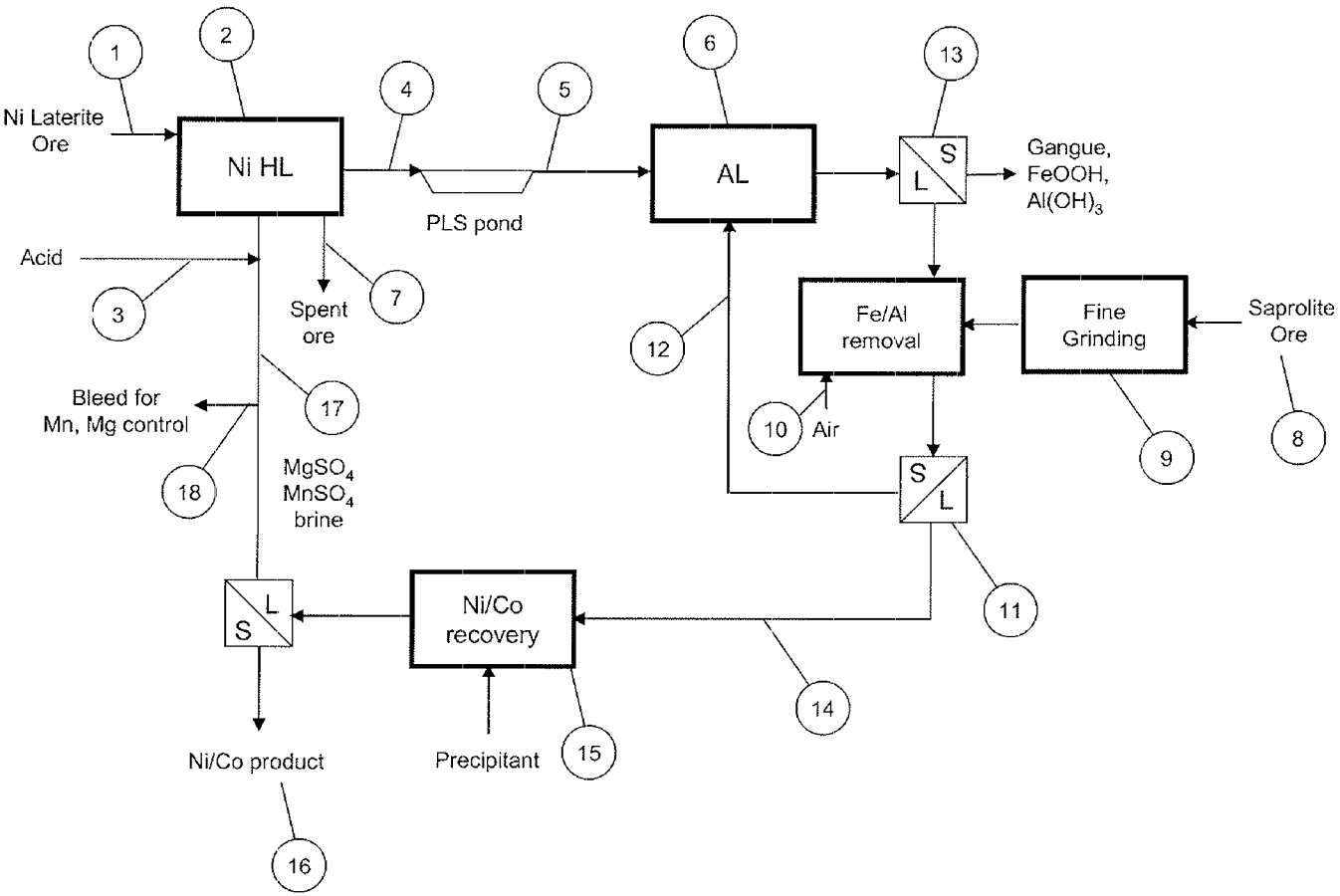
Ni Laterite Ore
1
Ni HL
2
Acid
3
4
PLS pond
5
AL
6
Spent ore
7
Saprolite Ore
8
Fine Grinding
9
Fe/Al removal
10
Air
S
L
11
12
13
Gangue, FeOOH, Al(OH)3
14
Ni/Co recovery
15
Precipitant
17
MgSO4 MnSO4 brine
18
Bleed for Mn, Mg control
Ni/Co product
16

SAPROLITE NEUTRALISATION OF HEAP LEACH PROCESS

This application claims priority to PCT Application Serial No. PCT/AU2009/000758 filed Jun. 16, 2009 published in English on Dec. 23, 2009 as PCT WO 2009/152560; and to Australian Application No. 2008903045 filed Jun. 16, 2008, the entire contents of each are incorporated herein by reference.

The present invention relates to a heap leach process for leaching a nickeliferous laterite ore to recover nickel and/or cobalt. In particular, the present invention relates to a method of heap leaching the laterite ore wherein the saprolite fraction of the laterite ore is ground and used to neutralise the pregnant leach solution (PLS) from the heap leach process. Saprolite ore includes alkaline minerals that are able to neutralise the PLS, leading to precipitation of iron present in the PLS. Under appropriate conditions aluminium may also be precipitated. Acid that is generated during the iron and aluminium precipitation is consumed by the saprolite and assists in leaching nickel and cobalt from it, hence maximising the use of acid in the process per tonne of nickel leached.

In a particular embodiment of the invention there is an atmospheric leach circuit where partially leached saprolite is subjected to an atmospheric leach to complete the leaching of nickel and/or cobalt from the saprolite. At the same time the precipitation of iron and aluminium is controlled during the atmospheric leach circuit by the addition of further saprolite.

BACKGROUND OF THE INVENTION

Laterite ores are potentially the world's largest source of nickel and cobalt. In general, most deposits of nickel/cobalt laterites contain three major zones based on morphology, mineralogy and chemical composition. These three zones, from the base to the surface, atop weathered parent bedrock materials are the saprolite zone, the transition zone and the limonite zone. There is generally a large variation in total thickness of the laterite deposit, as well as individual zone thickness.

The saprolite zone consists predominantly of "saprolitic serpentine" minerals and a large variety of nickel/magnesium silicate minerals. The weathering process, or "serpentinization" of the parent bedrock material is characterised by a decrease in the magnesium content and an increase in the iron content of the top layer of ore body. The resulting saprolite zone contains between 0.5% and 4% nickel and a higher magnesium content, which is normally over 6% wt.

The not well defined transition zone is composed essentially of limonite and saprolite. It also commonly contains nickel in the range of from 1.0% to 3.0% with co-existing cobalt ranging from 0.08% up to 1% (associated with asbolane, a hydrated manganese oxide).

The limonite zone, located on the top zone of the lateritic ore body, contains nickel ranging from about 0.5% to 1.8% and consists of goethite-rich and/or hematite-rich ore, which is rich in iron and cobalt. It has a lower magnesium content than saprolitic type ore. Due to stronger weathering, limonitic ore contains dominantly fine and soft particles of goethite and/or hematite. Sometimes the weathering has not been fully completed and either the hematite or the goethite rich sections are not present. Alternatively, depending upon the climatic condition, the limonite zone will still contain residual iron/aluminium silicates, such as nickel-containing smectite, nontronite and chlorite. At atmospheric pressure and ambient temperature, the acidic leach of limonite is slow. The whole-ore dissolution reaction using sulfuric acid is shown as follows:

Limonite Leach $$(Fe,Ni)O.OH+H_2SO_4 \rightarrow NiSO_4+Fe^{+3}+SO_4^{+2}+H_2O \quad \text{Eq. 1}$$

Goethite $$(Fe,Ni)_2O_3+H_2SO_4 \rightarrow NiSO_4+Fe^{+3}+SO_4^{+2}+H_2O \quad \text{Eq. 2}$$

Hematite

The iron content of limonite ore is normally in the range of 25-45% wt which corresponds to 40-72% wt goethite (FeOOH) or 36-64% wt hematite ($Fe_2O_3$).

Consequently the dissolution of Ni-containing goethite or hematite of a limonitic heap causes the instability of a heap, such as severe volumic slumping or shrinkage, and poor irrigation permeability.

The less-weathered, coarse, siliceous and higher nickel content saprolites tend to be commercially treated by a pyrometallurgical process involving roasting and electrical smelting techniques to produce ferro nickel. The power requirements and high iron to nickel ore ratio for the lower nickel content limonite blends make this processing route too expensive. Limonite ores are normally commercially treated by a combination of pyrometallurgical and hydrometallurgical processes, such as the High Pressure Acid Leach (HPAL) process, or the reduction roast—ammonium carbonate leach process.

Acid leaching of saprolitic ore is rarely practised commercially for the reason that a widely applicable process has not been developed for recovering the nickel from the leach solution in an economical and simple manner.

While heap leaching copper ores is well known as a commercial operation, there are several differences between heap leaching of copper containing ores that also contain some clay components, and the lateritic ores that have substantial fine and/or clay components. In addition, the acid consumption of laterite ore is ten-fold that of heap leaching copper ores.

Heap leaching of nickeliferous oxidic ore has been proposed in recovery processes for nickel and cobalt and is described, for example in U.S. Pat. Nos. 5,571,308 and 6,312,500, both in the name of BHP Minerals International Inc.

U.S. Pat. No. 5,571,308 describes a process for heap leaching of high magnesium containing laterite ore such as saprolite. The patent points out that the fine saprolite exhibits poor permeability, and as a solution to this, pelletisation or agglomeration of the ore is necessary to ensure distribution of the leach solution through the heap.

U.S. Pat. No. 6,312,500 also describes a process for heap leaching of laterites to recover nickel, which is particularly effective for ores that have a significant clay component (greater than 10% by weight). This process includes sizing of the ore where necessary, forming pellets by contacting the ore with a lixiviant, and agglomerating. The pellets are formed into a heap and leached with sulfuric acid to extract the metal values. Sulfuric acid fortified seawater may be used as the leach solution.

International application PCT/AU2006/000606 (in the name of BHP Billiton SSM Technology Pty Ltd) also describes a process where nickeliferous oxidic ore is heap leached using an acid supplemented hypersaline water as the lixiviant with a total dissolved solids concentration greater than 30 g/L in order to leach the heap.

Heap leaching laterites offers the promise of a low capital cost process, eliminating the need for expensive and high maintenance, high pressure equipment required for conventional high pressure acid leach processes. These patents and applications exclude the processing of limonitic laterite for heap leach because, in addition to the low reactivity, the reaction mechanism of whole-ore dissolution shown in Eq. 1 and 2 may lead to the collapse and/or poor permeability of the heap due to the dissolution of nickel containing goethite or hematite as outlined above.

Heap leaching of laterite nickel ore results in a solution containing nickel plus impurities such as iron and aluminium. Conventional processing requires that the iron and aluminium be precipitated before the nickel and cobalt are recovered. Typically, iron and aluminium are precipitated using limestone. This results in a slurry of iron and aluminium hydroxides together with gypsum.

The cost of limestone is not large, however it is an operating cost. The sulfate content of the gypsum by-product is derived from the original sulfuric acid added to the process. As the price of sulfur rises, better use of this acid content would reduce operating costs. Thus replacing the limestone for the neutralisation duty has potential to save both the cost of the acid equivalent to the gypsum, and also the cost of the limestone used for the precipitation process.

The present invention aims to provide a process where a saprolite ore may be used to neutralise the PLS from a heap leach process.

It is a desired feature of the present invention to provide a process where iron and/or aluminium impurities are effectively precipitated from the PLS without operating loss of sulfur through gypsum precipitation.

It is a further desired feature to better utilise the acid that is generated during the hydrolysis and precipitation of iron and/or aluminium, maximising the use of acid in the recovery of nickel and/or cobalt.

A reference herein to a patent document or other matter which is given as prior art is not to be taken as an admission that that document or matter was known or that the information it contains was part of the common general knowledge as at the priority date of any of the claims.

BRIEF DESCRIPTION OF THE INVENTION

Heap leaching of nickel and cobalt from laterite ores consumes acid and leads to a pregnant leach solution (PLS) that contains nickel, cobalt and other metals in solution such as iron and aluminium. Generally sulfuric or hydrochloric acid, or acid supplemented sea water is used as the lixiviant in such processes. These metals will be in the form of sulfate salts where sulfuric acid is used to leach the heap. Traditionally, iron may be removed by adding limestone to the acidic PLS to neutralise the PLS to a pH of about 3 to precipitate the ferric iron as an iron oxide or hydroxide, such as goethite, jarosite, paragoethite, natrojarosite or hematite. Aluminium is also precipitated by further neutralising the solution to a pH between about 3 to 5. Gypsum will be co-precipitated with the iron and/or aluminium.

The sulfate content of the gypsum by-product is derived from the original sulfuric acid added during the process. This represents an inefficient use of the acid in a nickel recovery process. The Applicants have found that limestone may be replaced for the neutralisation duty by using saprolitic ore, particularly finely ground saprolitic ore to neutralise the PLS from a heap leach process. Saprolite ores contain weakly alkaline minerals such as serpentine, which is a hydrated magnesium silicate.

The addition of saprolite enables the pH of the PLS from a heap leach process to be raised to between 0.5 and 3 in order to effectively precipitate iron, particularly as goethite, or jarosite if a jarosite precipitating ion such as sodium is present. Jarosite may be precipitated at a pH as low as 0.5, however goethite will tend to begin to precipitate above a pH of about 1.5. The iron may also be precipitated in other forms of iron oxides or hydroxides such as paragoethite, natrojarosite or even hematite with the addition of a hematite forming seed. At the same time, nickel and/or cobalt is leached from the serpentine component of a saprolitic ore with the acid liberated during the hydrolysis and precipitation of the iron. This results in a better use of the acid in the heap leach process as it avoids gypsum co-precipitation, and leaches the saprolite by utilising the available acid generated by the precipitation of iron.

Accordingly, in one embodiment, the invention resides in a heap leach process for the recovery of nickel and/or cobalt from a nickeliferous laterite ore, said process including the steps of:

a) providing one or more heaps of a nickeliferous laterite ore;
b) leaching the ore in a heap leach process by applying acid to one or more heaps to provide a pregnant leach solution;
c) neutralising the pregnant leach solution with ground saprolite ore; and
d) recovering the nickel and/or cobalt from the neutralised pregnant leach solution.

Following the heap leach process, the PLS is separated from the depleted ore and in a preferred embodiment, the PLS reports to an atmospheric leach circuit. The depleted ore may be discarded or recirculated to another heap for further processing.

Ground saprolite ore is added to the PLS to produce a neutralised PLS together with a solid residue. Preferably, the saprolite is finely ground. The ground saprolite may be added directly to the PLS following the heap leach process, or may be added to the leach solution that is derived from an atmospheric leach within the atmospheric leach circuit.

The acidic PLS from either the heap leach or atmospheric leach will partially leach the ground saprolite. Acid generated by the hydrolysis and precipitation of iron will also contribute to leaching the saprolite ore.

The solid residue, which includes partially leached saprolite, is separated from the neutralised PLS, and may be recycled to the atmospheric leach circuit step or to the heap leach step to complete leaching the partially leached saprolite.

The addition of the ground saprolite is sufficient to neutralise the acid content in the PLS so as to precipitate iron at a pH between about 0.5 to 3.5. Preferably, the iron is precipitated at a pH between about 1.0 to 1.8 as goethite, or jarosite if precipitated in the presence of a jarosite forming ion. Generally, a pH of at least 1.5 is needed to precipitate the iron as goethite. The acid liberated by the iron precipitation during the hydrolysis and precipitation of the iron is consumed by the saprolite and leaches nickel and/or cobalt from it.

The precipitated iron may be separated from the PLS as solid residue, with any unreacted saprolite ore. The PLS from the heap leach process would generally also contain aluminium. In order to precipitate the aluminium, the pH of the PLS will need to be adjusted to be within the range between about 3 to 5 to precipitate the aluminium as aluminium hydroxide. In order to achieve this, further saprolite may be added to the PLS from the atmospheric leach step after removal of the solid residue. If the ground saprolite includes sufficient carbonate, such as naturally occurring magnesite, siderite, dolomite and/or calcite, a pH of about 3 to 5 may be achieved, as these minerals are significantly more alkaline than the serpentine minerals of saprolite. Another alkali, such as limestone, may also be added to the PLS to supplement precipitation of aluminium and other impurities.

Hydrolysis and precipitation of the aluminium will also liberate further acid which is consumed by the carbonate values contained in the saprolite. In this case little or no nickel and cobalt can be expected to leach from the saprolite ore. However as the carbonate values would be the first to react with acid in conventional atmospheric or heap leaching, their use to precipitate aluminium constitutes a saving of acid, which would otherwise be consumed when the partly reacted saprolite is recycled to an atmospheric leach or heap leach step.

Aluminium is relatively sensitive to acid and may partially or completely redissolve if the pH is too low. It is therefore a balancing act to ensure that the aluminium is not redissolved during the iron precipitation step. Accordingly, it is a preferred embodiment to achieve separate precipitation of the iron and aluminium by first precipitating the iron at a pH of around 0.5 to 3.5; and then raising the pH to about 3 to 5 to precipitate the aluminium in a subsequent step. A build up of aluminium should not occur however, even if the pH is not raised sufficiently to precipitate the aluminium as aluminium hydroxide, as significant levels of the aluminium may be removed as a proportion of the aluminium will remain with the goethite and will eventually leave the circuit with the iron precipitate, provided that the pH of the PLS is such that the precipitated aluminium does not completely redissolve.

The PLS may also be oxidised to convert any ferrous ions present to ferric, to assist in precipitating the iron as an oxide or hydroxide such as goethite, paragoethite, jarosite, natrojarosite or hematite. The ferrous ions may be oxidised by injecting air directly into the PLS. This may occur before or during either the iron or aluminium precipitation step.

The partially leached saprolite may be continuously recirculated to the atmospheric leach step in order to complete leaching of the added saprolite. Alternatively, the partially leached saprolite may also be recycled to the heap leach stage. The solid iron residue and/or aluminium hydroxide is precipitated and removed during the atmospheric leach circuit.

In order to improve reactivity of the saprolite, it is preferably finely ground to be of a particle size $d_{80}$ of from 5 μm to 40 μm. Preferably the saprolite ore is ground to be of a particle size of approximately $d_{80}$ of 10 μm.

If the saprolite ore includes significant quantities of carbonate it may not need to be ground as finely, and may be ground to be a particle size of from $d_{80}$ from 30 μm to 150 μm. A preferred particle size of a saprolite that includes significant quantities of carbonate, would be in the order approximately 50 μm.

The nickel and/or cobalt may be recovered from the neutralised PLS by standard techniques such as a mixed hydroxide precipitation, for example by the addition of magnesia or another base; sulfide precipitation, for example by injecting hydrogen sulfide gas or another sulfide source; ion exchange or solvent extraction.

Once the nickel and/or cobalt has been recovered, the barren PLS may be recirculated to the heap leach process. The barren PLS is a relatively clean product, but it may have manganese and magnesium sulfates which may be bled from the solution prior to recirculating to the heap leach process.

SUMMARY OF THE DRAWINGS

FIG. 1 illustrates a flowsheet of a preferred embodiment of the invention. It should be understand however, that this flowsheet is illustrative of a preferred embodiment, and the process of the invention should not be considered to be limited thereto.

DETAILED DESCRIPTION OF THE INVENTION

The detailed description of the invention will be described with reference to FIG. 1. In this embodiment of the invention, a nickeliferous laterite ore (1) is formed into a heap (2) where the ore is leached by the addition of acid (3). Generally, the whole of the laterite ore is subjected to the heap leach however, as part of the saprolitic ore will be used for the neutralisation step, the heap may be constructed from the limonite and any excess saprolite. The ore construction however is dependent upon the available ore and the availability of saprolite for the neutralisation step. Preferably the acid is sulfuric acid, but other acids such as hydrochloric may be used or acid supplemented sea water. The solution eluted from the heap leach is collected (4) with or without recycling to give a pregnant leach solution (PLS) (5) which then reports to an atmospheric leach circuit (6). The spent ore (7) is sent to tailings, or may be recirculated to a secondary heap for further heap leach processing.

In the atmospheric leach circuit, saprolite ore (8) is added to the PLS. This may be done initially to the PLS directly from the heap leach, or the PLS that is the result of the atmospheric leach circuit. The saprolite ore may be subjected to fine grinding (9), for example in a stirred mill. Additional heat may be added if required. Preferably, the temperature of the PLS may be raised to about 95° C. for the saprolite addition.

The saprolite ore consumes the acid liberated during the hydrolysis and precipitation of iron during the atmospheric leach circuit, which acid is able to leach nickel and/or cobalt from the saprolite. The acidic PLS from either the heap leach or atmospheric leach also assists in leaching the saprolite. This maximises the usage of acid in the leach process. Air (10) may be injected, together with the ground saprolite, to oxidise any ferrous ions to ferric ions to assist precipitation of iron. The iron may be precipitated as goethite, where fresh waters are used to form the slurries, or jarosite if saline waters are used for the slurries or to supplement the acid. Hematite precipitation may also occur if a hematite seed is added during the leach or precipitation stages. Precipitation as jarosite has some advantage as it may be better for nickel extraction from the saprolite due to a lower operating pH. Jarosite may be precipitated at a pH as low as 0.5. It does however have the disadvantage that less acid is liberated therefore net acid consumption increases.

It has been found that finely grinding the saprolite ore increases the reactivity of the saprolite to enable it to be used to neutralise the PLS and to control the pH to a sufficient extent to precipitate both iron and aluminium from the PLS.

Saprolite ores contain weakly alkaline minerals such as serpentine, which is a hydrated magnesium silicate. Typically, a pH of 3 or lower is required to usefully leach serpentine. Once the saprolite is added to the PLS, and after sufficient time allowed for reaction, the resultant slurry is subjected to a solid/liquid separation step (11), and the resultant solid residue (12), which includes partially leached saprolite, is treated in the atmospheric leach step (6) at a pH of, for example 0.5 and 3.5, to further leach the nickeliferous serpentine while precipitating the ferric ions. Alternatively, the partially leached saprolite may be recycled to a heap leach step. Preferably, the atmospheric leach is carried out at a pH of about 1.0 to 1.8, where reasonable nickel leaching from the saprolite is obtained while the iron is precipitated as an iron oxide or hydroxide such as goethite or jarosite. Generally a pH of at least 1.5 is required to precipitate the iron as goethite. The acidic PLS (5) from the heap leach process, or the acidic PLS as part of the atmospheric leach circuit, is used as an acidic source together with the acid liberated during the iron precipitation in order to leach the saprolite.

Saprolite may also contain carbonate minerals, such as calcite, siderite, dolomite and magnesite, all of which are significantly more alkaline than serpentine. Therefore, it is possible to use the greater alkalinity of these minerals, which have a similar reactivity to limestone, to more effectively precipitate aluminium. A further alkali such as limestone may be added in smaller quantities to assist in precipitating the aluminium and other impurities if required.

Aluminium requires a pH of about 3 to 5 in order to precipitate as aluminium hydroxide. During the aluminium precipitation, almost no nickel would be leached. It is therefore a preferable embodiment to include separate steps of iron precipitation at a pH of from 0.5 to 3.5 to precipitate part or all of the iron as an iron oxide or hydroxide and then control the pH by the addition of further saprolite, or saprolite that contains carbonate material, possibly supplemented by the addition of a further alkali, in order to precipitate the aluminium at a pH of 3 to 5 as aluminium hydroxide in the subsequent iron/aluminium removal step.

During the iron precipitation process, a coarser saprolite slurry may be used. Typically, the saprolite ore may be finely ground to be of a particle size $d_{80}$ of from 5 μm to 40 μm with a preferred particle size of approximately $d_{80}$ of 10 μm.

If the saprolite ore includes sufficient carbonate, the ore may not need to be as finely ground. With the presence of carbonate, the ore may be ground to a particle size $d_{80}$ of from 30 μm to 150 μm but preferably about 50 μm.

The atmospheric leach step (6) substantially completes leaching the saprolite, together with precipitation of iron as an iron oxide or hydroxide such as goethite, paragoethite, jarosite, natrojarosite or hematite and/or aluminium as aluminium hydroxide. The discharge slurry from the atmospheric leach (6) is then subjected to a solid/liquid separation step (13), with the solid iron precipitate and aluminium hydroxide disposed of to tailings, and the acidic PLS neutralised with finely ground saprolite as discussed.

By this process, both aluminium and iron are precipitated from the PLS from the heap leach process. In a preferred embodiment the pH of the PLS is controlled to achieve precipitation of both iron as an iron oxide or hydroxide such as goethite or jarosite, and aluminium as aluminium hydroxide.

Aluminium hydroxide is relatively sensitive to acid and may redissolve if the pH is too low. Any aluminium hydroxide may partly or completely redissolve during the iron precipitation step if the pH is from about 0.5 to 2.5. Whereas it is preferred to have a circuit where aluminium is precipitated during the atmospheric leach step at a pH of from about 3 to 5 to achieve effective removal of the aluminium, it has been found however that the problem of any aluminium redissolving during the iron precipitation step is avoided in that sufficient aluminium remains in the iron precipitate, particularly goethite, to provide an outlet for the aluminium and eventually aluminium will leave the plant with the iron precipitate. It is therefore possible to remove a sufficient level of the aluminium while operating the atmospheric leach circuit at a pH of about 0.5 to 3.5, provided that the final pH is such that a part of the precipitated aluminium does not redissolve. This may be achieved by increasing the pH through the course of the atmospheric leach stage (6).

Following solid/liquid separation step (11), where partially leached saprolite, and iron and aluminium have been removed, the pregnant leach solution (14) then reports for nickel and/or cobalt recovery (15) where the nickel and/or cobalt may be recovered as a mixed hydroxide following the addition, for example of magnesia, or as a mixed sulfide using, for example hydrogen sulfide gas. Alternatively, the nickel and/or cobalt may be recovered by other standard processes such as ion exchange or solvent extraction.

The nickel and/or cobalt product (16) is recovered, while the barren solution (17) may be recirculated to the heap leach process. Any manganese and magnesium present in the barren solution may be controlled by bleeding the barren solution (18) before recirculating to the heap leach process.

The invention described herein is acceptable to variations, modification and/or additions other than those specifically described and it is to be understood that the invention includes such variations, modifications and/or additions which fall within the spirit and scope of the above Description.

The invention claimed is:

1. A heap leach process for the recovery of nickel and/or cobalt from a laterite ore, comprising:

a) providing one or more heaps of a nickeliferous laterite ore;

b) leaching the ore in a heap leach step by applying acid to the one or more heaps to provide a pregnant leach solution;

c) neutralizing the pregnant leach solution with ground saprolite ore to a pH of from 0.5 to 3.5 to precipitate iron as an iron hydroxide or oxide, and adding further ground saprolite to adjust the pH of the pregnant leach solution to a pH of about 3 to 5 to precipitate aluminium as aluminium hydroxide; and d) recovering the nickel and/or cobalt from the neutralised pregnant leach solution.

2. A process according to claim 1 wherein the pregnant leach solution reports to an atmospheric leach circuit.

3. A process according to claim 2 wherein the ground saprolite ore is added either directly to the pregnant leach solution from the heap leach step, or to a pregnant leach solution derived during the atmospheric leach circuit, to produce a neutralized pregnant leach solution together with a solid residue containing partially leached saprolite.

4. A process according to claim 3 wherein the solid residue containing partially leached saprolite is separated from the neutralized pregnant leach solution and is recycled to the atmospheric leach circuit or to the heap leach step to complete leaching of the saprolite.

5. A process according to claim 4 wherein iron is precipitated as goethite, paragoethite, jarosite, natrojarosite, hematite or another iron oxide or hydroxide during the atmospheric leach circuit and the ground saprolite is added in sufficient quantity to neutralize acid liberated by the iron precipitation, while the acid leaches nickel and/or cobalt from the saprolite ore.

6. A process according to claim 5 wherein ferrous ions are oxidized to ferric ions to assist in precipitating the iron as goethite or jarosite.

7. A process according to claim 6 wherein air is injected into the product leach solution to oxidize ferrous ions to ferric.

8. A process according to claim 5 wherein another alkali is added to the pregnant leach solution to assist in completing precipitation of aluminium and other impurities.

9. A process according to claim 5 wherein iron is disposed of as goethite, paragoethite, jarosite, natrojarosite or hematite and aluminium is disposed of as aluminium hydroxide following the atmospheric leach.

10. A process according to claim 2 wherein the iron and aluminium are precipitated in separate atmospheric leach circuits.

11. A process according to claim 1 wherein the ground saprolite includes sufficient carbonate to neutralize the acid content in the pregnant leach solution sufficiently so as to precipitate substantially all iron as an iron oxide or hydroxide and all aluminium as aluminium hydroxide at a pH of from 3 to 5.

12. A process according to claim 11 wherein the carbonate present in the saprolite comes from naturally occurring minerals including magnesite, siderite, dolomite and calcite.

13. A process according to claim 11 wherein the saprolite ore includes carbonate and is ground to a particle size $d_{80}$ of from 30 μm to 150 μm.

14. A process according to claim 13 wherein the particle size of the ground saprolite ore is $d_{80}$ of approximately 50 μm.

15. A process according to claim 1 wherein the saprolite ore is finely ground to be of a particle size $d_{80}$ of from 5 μm to 40 μm.

16. A process according to claim 15 wherein the saprolite ore particle size is approximately $d_{80}$ of 10 μm.

17. A process according to claim 1 wherein nickel or cobalt is recovered from the neutralized product leach solution by mixed hydroxide precipitation, sulfide precipitation, ion exchange or solvent extraction.

18. A process according to claim 17 wherein following the nickel or cobalt recovery, the barren solution is recirculated to the heap leach process.

* * * * *

UNITED STATES PATENT AND TRADEMARK OFFICE

CERTIFICATE OF CORRECTION

PATENT NO. : 8,454,723 B2
APPLICATION NO. : 12/991848
DATED : June 4, 2013
INVENTOR(S) : Liu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 93 days.

Signed and Sealed this
Eighth Day of September, 2015

Michelle K. Lee

Michelle K. Lee
*Director of the United States Patent and Trademark Office*